United States Patent [19]

Reis

[11] Patent Number: 4,574,424

[45] Date of Patent: Mar. 11, 1986

[54] HANDLE AND PULL-OUT PART ON CUPBOARDS AND SHELVES

[75] Inventor: Anton Reis, Sulgen, Switzerland

[73] Assignee: Lista AG., Erlen, Switzerland

[21] Appl. No.: 631,873

[22] Filed: Jul. 18, 1984

[30] Foreign Application Priority Data

Jul. 19, 1983 [CH] Switzerland ..... 3948/83

[51] Int. Cl.[4] ..... B65D 25/28

[52] U.S. Cl. ..... 16/114 R; 16/124; 16/DIG. 24

[58] Field of Search ..... 16/114 R, 124, 125, 16/DIG. 24, DIG. 40; 312/320

[56] References Cited

U.S. PATENT DOCUMENTS

| | | | |
|---|---|---|---|
| 2,758,748 | 8/1956 | Konefes | 312/320 X |
| 3,567,303 | 3/1971 | Fox et al. | 312/320 |
| 3,579,711 | 5/1971 | Nicoln | 16/114 R |
| 3,939,973 | 2/1976 | Wallestad | 16/114 R X |
| 4,002,386 | 1/1977 | McKenzie | 312/320 |
| 4,096,603 | 6/1978 | Klaws | 16/114 R X |

FOREIGN PATENT DOCUMENTS

| | | | |
|---|---|---|---|
| 635992 | 5/1983 | Switzerland | 16/114 R |

*Primary Examiner*—Fred Silverberg

*Attorney, Agent, or Firm*—Bachman & LaPointe

[57] ABSTRACT

A handle comprises a gripping profile having a central portion provided with an upper and a lower edge. The central portion has a curved outer face serving as a viewing area and is defined by a pair of opposed slots for securing foils bearing indicia to the viewing area. The curved outer face of the central portion extends above a horizontal plane at an angular range $\alpha$ and below the same horizontal plane at an angular range $\beta$, where $\alpha < \beta$. On the inside of the gripping profile, the upper edge is provided with a holding bulge and the lower edge is provided with a holding web. The gripping profile is fixed to a holder on the pull-out part, by positively engaging the free end of the holder with the holding web, while the holding bulge snaps into a corresponding concave curvature provided on the holder. As a result, the handle is reliably secured. With the curved outer face of the central portion extending on either side of the horizontal plane, the viewing area of the handle offers good visibility from below as well as above and, as a result of the wide lower edge, is easy to grip.

7 Claims, 3 Drawing Figures

HANDLE AND PULL-OUT PART ON CUPBOARDS AND SHELVES

BACKGROUND OF THE INVENTION

The present invention relates to a handle for operating a pull-out part on cupboards and shelves and the like and comprises a gripping profile secured to a holder on the pull-out part.

Pull-out parts of random types such as drawers, rack broads and compartments which can be pulled out, must be provided with a suitable handle so that they can be pulled out when required. The sliding back of the pull-out part can be effected without using the handle by merely exerting a pressure on the front face of the part.

Numerous different handle constructions are known. Distinctions can be drawn between several larger groups of handles, as a function of the intended use of the pull-out parts. Thus, in connection with cupboards and shelves of the types used in offices, workshops and shops, it is known to use a handle, which is constructed as a gripping ledge and which is positioned on the front face of the pull-out part. For reasons of convenience the gripping ledge should have a length roughly corresponding to the total width of the pull-out part face. The actual gripping ledge is constructed of an angular profile with two legs, one leg forming an attachment flange by which the gripping ledge engages with the pull-out part face and which is fixed thereto by means of screws or the like. The other leg constitutes the gripping leg used for sliding the pull-out part in and out. The gripping leg projects from the front face with a convex curvature and forms with the attachment flange an angle which is generally somewhat less than 90°, while extending over an angular range, which is somewhat above the horizontal plane and up to the vertical plane of the pull-out part face. In addition, on the visible outside, the gripping ledge can be provided with means permitting the fixing of foils with inscriptions or the like.

Although these known gripping ledges have proved satisfactory in many applications, they still suffer from certain disadvantages giving rise to an improvement. Firstly, the gripping ledge must be fixed by means of screws or the like to the pull-out part face. In the case of heavier pull-out parts where the fixture must be equally strong, attachment by screws is far from easy. Another disadvantage is that the angular region covered by the gripping leg, despite offering a good visibility of any lettering on the leg from above, offers limited visibility from the front and particularly from below. The foregoing is a significant disadvantage especially in the case of high cupboards and shelves.

Accordingly it is the principal objects of the present invention to develop a handle of the aforementioned type and a pull-out part equipped therewith which exhibits adequate strength, is easy to operate when sliding the pull-out part in and out and ensures good visibility on the outside of the gripping ledge particularly when viewed from the front and from the bottom.

SUMMARY OF THE INVENTION

The foregoing objects are achieved by way of the present invention wherein the gripping ledge is constructed as a gripping profile whose lower edge, which is gripped on operating the pull-out part, has a holding web intended to embrace the free edge of a holder and whose upper edge has a holding bulge on the inside surface thereof.

In accordance with the present invention the holder for receiving the handle may be formed as an integral part of the pull-out part or may be provided as a separate piece on the front face of the pull-out part.

BRIEF DESCRIPTION OF THE DRAWINGS

The present invention will be described in greater detail hereinafter relative to non-limitative embodiments and with reference to the attached drawings, wherein.

DETAILED DESCRIPTION

Figure 2:
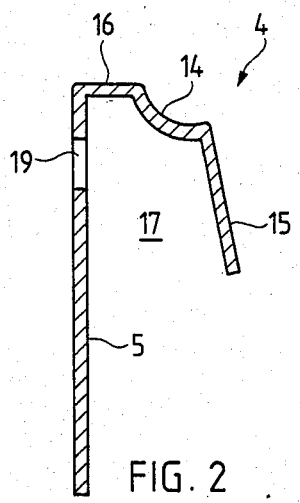
FIG. 2 is a vertical section through the front wall of a pull-out part with a holder for receiving the handle according to FIG. 1 in a smaller scale than FIG. 1.
Figure 1:
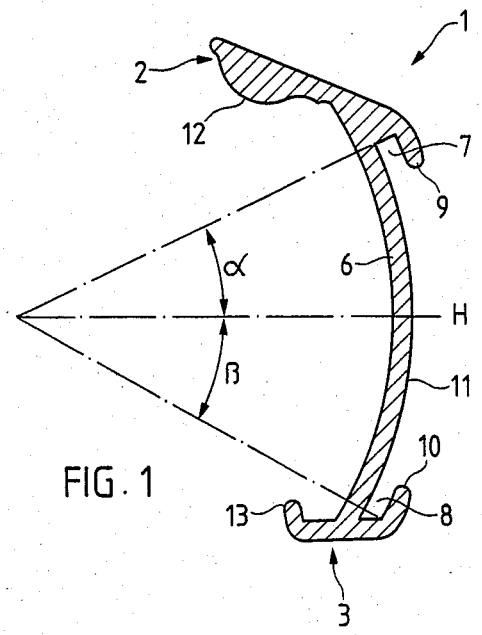
FIG. 1 is an enlarged scale vertical section through a gripping ledge for a handle for operating a pull-out part in accordance with the present invention.

The gripping ledge shown in FIG. 1 is a profile, which is appropriately produced as an extruded gripping profile 1 from light metal, plastic or the like. Both the upper edge 2 and the lower edge 3 of gripping profile 1 are provided for the positive mounting of the profile 1 to a holder 4 shown in FIG. 2. With reference to FIG. 2, a holder 4 is shown as an integral part of the front wall 5 of a pull-out part, such as a drawer or the like. It should be noted that the holder 4 can also be produced individually and then wall 5 is constructed as a short fixing leg. The holder 4 constructed as set forth above can be fixed or shaped onto any random pull-out part, such as rack boards, etc.

Gripping profile 1 has a convex central portion 6. Slots 7 and 8 are shaped onto the top and bottom end of central portion 6, and are defined on the one hand formed by the central portion 6 and on the other by webs 9 and 10. The webs 9 and 10 appropriately extend over the entire length of gripping profile 1. The visible outer face 11 of central portion 6 forms the support for inscribed foils, which are secured in slots 7 and 8 and consequently cannot fall out. As can be seen in FIG. 1, the outer face 11 extends on either side of a horizontal plane H, the visual range angle $\alpha$ above horizontal plane H being somewhat smaller than the visual range angle $\beta$ located below the horizontal plane H. Angle $\alpha$ can be between 20° and 28° and angle $\beta$ can be between 25° and 35°. The arrangement of the convex outer face 11 on either side of the horizontal plane H which defines the viewing area for inscribed foils placed on it, is important because it leads to better observation from the front and bottom thereof. Due to the approximately vertical arrangement, the dazzle of outer face 11 is reduced. The upper edge 2 of gripping profile 1 connected to central portion 6 has a convexly shaped holding bulge 12 on the inside surface thereof and this appropriately has a circular segmental profile.

The lower edge 3 connected to central profile internally has a holding web 13 which, together with holding bulge 12, serves as holding means for the positive fixing of gripping profile 1 to holder 4. As a result of the shape of holding web 13, the lower edge 3 of gripping profile 1 not only forms a narrow edge, but, due to the holding web 13, also has a certain extension. The extension makes it possible to easily grip the handle whose lower edge 3 is gripped with the hand for operating the pull-out part.

Holder 4 according to FIG. 2 forms a support leg, which comprises an external concavely curved section 14 and a leg section 15 connected thereto. Holder 4 passes into a spacing member 16, which determines the size of the cavity 17 formed by holder 4, whose slope is determined by the shape of gripping profile 1. By means of spacing member 16, the cavity 17 can be chosen sufficiently large that the gripping profile 1 placed on holder 4 can be easily gripped.

Figure 3:
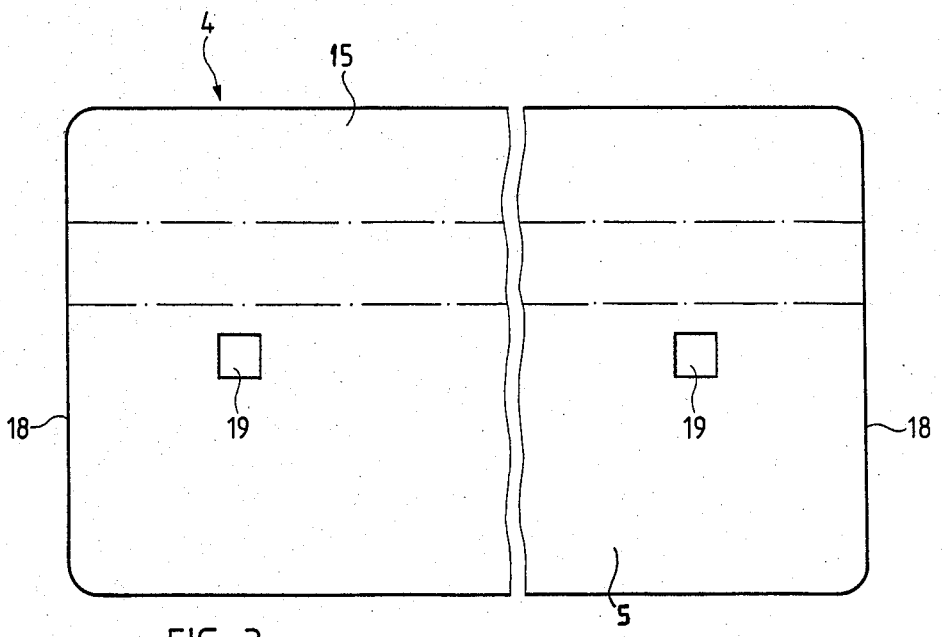
FIG. 3 is a side view of the front wall of the pull-out part in the unfolded state.

The wall plate shown in FIG. 3 is used for forming wall 5 and holder 4 according to FIG. 2. The broken lines correspond to the bending edges between wall 5 and spacing member 16 on the one hand and curved section 14 and leg section 15 on the other. In the vicinity of each of the two lateral edges 18, a square opening 19 is stamped out of the wall plate. Openings 19, which can also have a different shape, are used for holding a cover fitted to the end of gripping profile 1 as is described in DOS No. 3,219,926 to the present Applicant. Openings 19 can also be used for fixing an operating rod for indlvidually securing the pull-out part.

The aforementioned gripping profile 1 is secured on holder 4 in the following manner. Holding web 13 is initially placed around leg section 15 and then the holding bulge 12 is pressed into the curved section 14. Gripping profile 1 is somewhat elastically deformed and then snaps without clearance into the concave curved section 14 of holder 4. This mounting support is positively engaged, because holding bulge 12 can only be detached again from holder 4 by elastic deformation of gripping profile 1. The holding web 13 also positively engages the leg section 15. Gripping profile 1 can be used on any pull-out part on which a holder 4 is provided. As has already been stated, this need not be shaped onto wall 5 as an integral part.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A handle for use on and in combination with a pull-out such as a shelf comprising a gripping profile and a holder, said holder having a front wall, a spacing member and a flat leg section connected together with said spacing member by a concavely curved section, said front wall, said spacing member and said leg section forming a cavity therebetween, said leg section being shorter than the front wall and extending at an angle away from the front wall, said gripping profile having an upper edge and a lower edge, said upper edge being provided on the inside surface thereof with a bulge received in said concavely curved section for securing said gripping profile to said holder and said lower edge being provided on the inside surface thereof with a holding web that engages said leg section for securing said gripping profile to said holder wherein said lower edge of said gripping profile is gripped when said part is pulled out.

2. A handle according to claim 1 wherein bulge is convexly shaped and has a circular segmental profile.

3. A handle according to claim 1 wherein said gripping profile is provided between the upper and lower edges thereof with a central portion having an outer face which forms a viewing surface for receiving inscribed foils.

4. A handle according to claim 3 wherein webs are provided on the top and bottom of said central portion and define with said central portion opposed slots for receiving said inscribed foils.

5. A handle according to claim 3 wherein said central portion is curved.

6. A handle according to claim 3 wherein the outer face extends over an angular range on either side of a horizontal plane such that the angle below the horizontal plane is larger than the angle above the horizontal plane.

7. A handle according to claim 6 wherein the angular range above the horizontal plane is between 20° and 28° and the angular range below the horizontal plane is between 25° and 35°.

* * * * *